US005737892A

United States Patent [19]

Greenberg

[11] Patent Number: 5,737,892

[45] Date of Patent: Apr. 14, 1998

[54] CHANNEL-MOUNTED INTERLOCKING PANEL ROOFING STRUCTURE

[75] Inventor: Percy Greenberg, St. Louis Park, Minn.

[73] Assignee: Crown Partnership, Anoka, Minn.

[21] Appl. No.: 686,219

[22] Filed: Jul. 23, 1996

Related U.S. Application Data

[63] Continuation-in-part of Ser. No. 651,043, May 17, 1996.

[51] Int. Cl.[6] ..... E04D 1/34

[52] U.S. Cl. ..... 52/469; 52/578; 52/549

[58] Field of Search ..... 52/461, 464, 465, 52/469, 528, 546, 547, 549, 551, 588.1

[56] References Cited

U.S. PATENT DOCUMENTS

| | | | |
|---|---|---|---|
| 2,907,287 | 10/1959 | Trostie | 52/461 X |
| 3,327,443 | 6/1967 | Gay et al. | 52/463 X |
| 3,603,056 | 9/1971 | Roth | 52/461 X |
| 4,091,588 | 5/1978 | Heirich | 52/478 |
| 4,114,340 | 9/1978 | Dean et al. | 52/520 |
| 4,133,161 | 1/1979 | Lester | 52/748 |
| 4,135,342 | 1/1979 | Cotter | 52/461 |
| 4,155,206 | 5/1979 | Player | 52/508 X |
| 4,269,012 | 5/1981 | Mattingly et al. | 52/394 |
| 4,271,651 | 6/1981 | Sorells | 52/460 |
| 4,366,656 | 1/1983 | Simpson | 52/528 X |
| 4,388,789 | 6/1983 | Murphy | 52/461 |
| 4,495,743 | 1/1985 | Ellison et al. | 52/478 |
| 4,522,007 | 6/1985 | Oehlert | 52/588 |
| 4,590,730 | 5/1986 | Blendick | 52/461 |
| 4,700,522 | 10/1987 | Simpson | 52/528 |
| 4,947,609 | 8/1990 | Champagne | 52/547 X |
| 4,987,716 | 1/1991 | Boyd | 52/520 |
| 5,012,623 | 5/1991 | Taylor | 52/531 |
| 5,140,793 | 8/1992 | Knudson | 52/520 |
| 5,187,911 | 2/1993 | Cotter | 52/528 X |
| 5,201,158 | 4/1993 | Bayley et al. | 52/537 |
| 5,247,772 | 9/1993 | Greenberg | 52/531 |
| 5,339,608 | 8/1994 | Hollis et al. | 52/547 X |
| 5,423,157 | 6/1995 | Watanabe | 52/461 X |

OTHER PUBLICATIONS

MM Systems Corporation, drawings (6 pages), published on date prior to or even herewith.

*Primary Examiner*—Carl D. Friedman
*Assistant Examiner*—Beth Aubrey
*Attorney, Agent, or Firm*—Nawrocki, Rooney & Sivertson

[57] ABSTRACT

A structure for securing the edges of adjacent roof-forming panels is described. Channel members having gutter forming bottom and side walls engage the edges of adjacent panels. Specifically, ledges or the channel side walls cooperate with structures on the panel edges to secure the panel edges. A closure encloses the channel gutter.

16 Claims, 8 Drawing Sheets

CHANNEL-MOUNTED INTERLOCKING PANEL ROOFING STRUCTURE

CROSS-REFERENCE TO CO-PENDING APPLICATION

This is a continuation-in-part of co-pending application Ser. No. 08/651,043 filed on May 17, 1996.

BACKGROUND OF THE INVENTION

1. Field of the Invention

This invention relates generally to the field of panel systems for covering a structure; and, more particularly, to structures for mounting panels such as those found in a standing seam type roof.

2. State of the Prior Art

It is known to use interlocking building panels for covering walls or for roof covering. Such interlocking panels have the advantages of ease of fabrication and assembly over other forms of covering materials. In general, the interlocking panels are of substantially lighter weight than other forms of covering materials and have proven to be durable and aesthetically pleasing.

It is common in building structures to have a primary structural system that provides basic support, together with a secondary structural system mounted on the primary system. It is the function of the secondary structural system to provide the means for attaching the paneled covering structures. The secondary structural system commonly is in the form of a spaced-apart system of bar joists or purlins to which the panels are to be attached.

In a standing seam roofing system, a common method of attachment is the use of clips affixed to the purlins. Such clips have taken various forms, all of which exhibit deficiencies both in structural integrity and in difficulty of installation. Examples of various configurations of clips are described in U.S. Pat. Nos. 4,269,012 to Mattingly et al., 4,495,743 to Ellison et al., and 4,114,340 to Dean et al. Each of these patents teach the mounting of clips to purlins, and an interlocking relationship to the mounted panels. It is of course apparent that the panels are only supported and retained at spaced-apart locations depending on the spacing of the purlins and are held down only at the clip locations. Such a spaced-apart mounting results in a requirement that the panels be of substantially more rigid or heavy gauge material in order to support surface loading such as may be required, and to withstand wind lift. Further, the use of clips tends to yield an aesthetically unpleasing wavy appearance of the covering due to the spaced-apart interconnections.

The edges of adjoining panels of a standing seam roof form a seam at some distance above the level of the roof panel. This arrangement allows water to be drained away along the surface of the panels without allowing infiltration through the seam. Examples of standing seam structures are set forth in U.S. Pat. Nos. 4,700,522 issued to Simpson, 4,987,716 issued to Boyd, and the patents to Ellison, Dean et al., and Mattingly et al. identified above. These examples of standing seam roof panel systems and the various structures for fastening them to the building structure, all fail to provide substantially full support and retention along the lengths of the panels. These mounting mechanisms are subject to failure in wind lift conditions.

Various systems for directly affixing panel assemblies to a supporting structure have been described. Such systems often provide for screwing or nailing down a panel edge, and then having the screws or nails covered by a portion of the next panel. U.S. Pat. No. 4,133,161 issued to Lester summarizes many of the earlier systems and describes a screw fastened structure. This arrangement is deficient in the amount of labor necessary to screw the panels together, and from the likelihood of water infiltrating the seam over time.

Various forms of interlocking panel structures have been developed. These structures variously have the goals of ease of installation, minimization of mounting structures, and attractive appearances. Examples are provided in U.S. Pat. Nos. 4,091,588 issued to Heirich, 4,522,007 issued to Oehlert, 5,012,623 issued to Taylor, 5,140,793 issued to Knudson, and 5,201,158 issued to Bayley et al., all of which try to cover or hide the structures that mount the panels. It is apparent, however, that these structures rely on placing fastening devices through some portion of the panels, thereby tending to deform the panels along the fastened edges. Wind lift of these panels is restrained only by the head contact of the fastening devices, which in light weight material are subject to being torn out. U.S. Pat. 5,247,772 issued to Greenberg and assigned to the assignee of this invention is similarly limited with regard to wind lift.

To address the deficiencies of the prior art, this invention was developed to provide an improved longitudinal mounting system for affixing adjoining panels to a structure. An elongated channel member having a structure mounting portion and having a pair of mounting shoulders or flanges for engaging mounting slots in adjacent panels is utilized to provide an improved means to affix panels to a structure. The panel members have mounting slots to cooperate with the mounting shoulders to provide panel support and retention along each of its mounting edges, thereby providing enhanced load bearing support and improved retention when subjected to wind lift. These and other more detailed objectives of the invention will become apparent to those skilled in the art from a consideration of the drawings and the description of the preferred embodiment.

SUMMARY OF THE INVENTION

The present invention provides an improved mounting mechanism for affixing covering panels to a structure. The panels each have elevated portions extending along the length of the sides of the panels. Each elevated portion is adapted to cooperate with an associated elevated portion of an adjacent panel to form a closure that can include a standing seam. Alternatively, a cap may be employed to cover the seam. Each of the elevated portions includes a substantially continuous longitudinal mounting slot extending along the panel length.

An elongated mounting channel member is utilized to affix adjacent panels to a support structure. The mounting channel member utilizes oppositely disposed longitudinal supporting members, or shoulders, to engage the mounting slots of adjacent panels to thereby firmly support adjacent panels when the closure of the seam between adjacent panels is completed. The panel mounting structure minimizes the ability of moisture to infiltrate since the mounting devices are enclosed within the closure and there is a substantially continuous, gutter like impervious surface at the bottom of the channel.

The present invention is thus an improved mechanism for mounting panels to a structure that has the advantages shown in prior art standing seam mounting systems, but does not have the disadvantages of the need for a plurality of mounting clips. The use of the supporting slots in the panels in conjunction with the mounting shoulders of the elongated channel mounting members provides substantially continuous support and retention along the length of the adjacent panels, and provides an aesthetically pleasing appearance of the structure while yielding enhanced structural performance. In particular, the present invention will allow a reduction in the number of purlins employed (by increasing the allowable distance between them) while improving the resistance to wind lift.

DETAILED DESCRIPTION OF THE INVENTION

Figure 1:
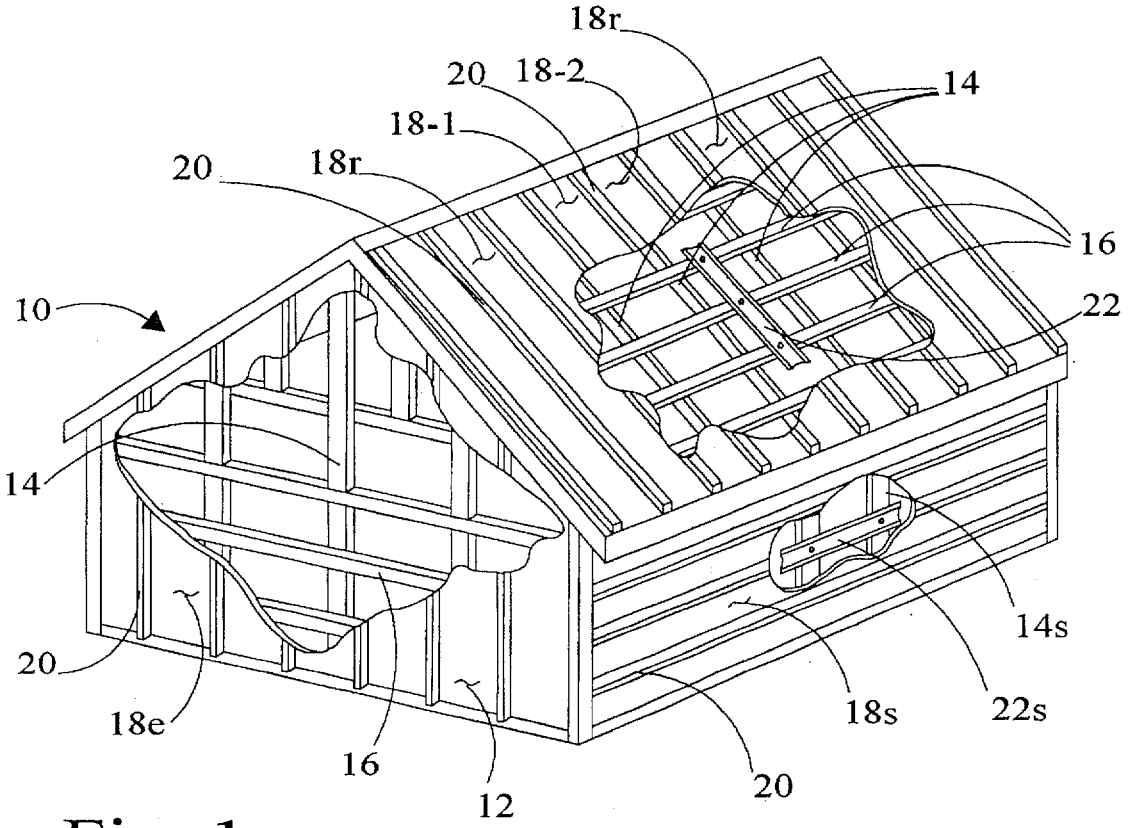
FIG. 1 is a pictorial view of a building with portions broken away to disclose the primary and secondary structures and with the improved channel-mounted panel structure of the present invention forming a continuous surface covering.

When referring to the drawings, like reference numerals will denote like elements throughout the various views.

FIG. 1 is a pictorial view of a building with portions broken away to disclose the primary and secondary structures and with the improved channel-mounted panel structure of the present invention forming a continuous surface covering. The building 10 has a lower portion 12 that supports a plurality of primary support structures 14. The primary support structures 14 provide the basic structural support and load bearing strength. A plurality of secondary support structures shown as purlins 16 are arranged transverse to the primary support structures 14. These are shown both in the exposed roof area and the exposed end area. The purlins 16 are fashioned in the known manner and are utilized to attach the surface covering and the panels. The number and spacing of purlins 16 will be determined by the load bearing support requirements and the number of fastening points necessary to safely secure the panels. When used horizontally, the side panels **18*s* can be affixed to the primary vertical support members 14*s* via channels 22*s*. The end panels 18*e* can be installed with the standing seams 20 in the vertical arrangement. It is of course understood that the side panels 18*s* or the end panels 18*e*** can be utilized in either the vertical or horizontal orientation depending upon the available secondary support structure and the desired aesthetic appearance. Metal bar joists can be used in lieu of purlins.

The covering is comprised of a plurality of panels that are fashioned from sheet material, such as sheet metal or aluminum, so that adjacent panels, such as panels 18-1 and 18-2, are joined at a standing seam 20. The standing seams 20 will be described in more detail below.

Adjacent pairs of roofing panels **18*r* are supported by a channel member 22 (known in the art as a hat channel) that is in turn affixed to purlins 16** by nails, bolts, screws, or such other fastening devices as may be appropriate for the selected materials.

Figure 2:
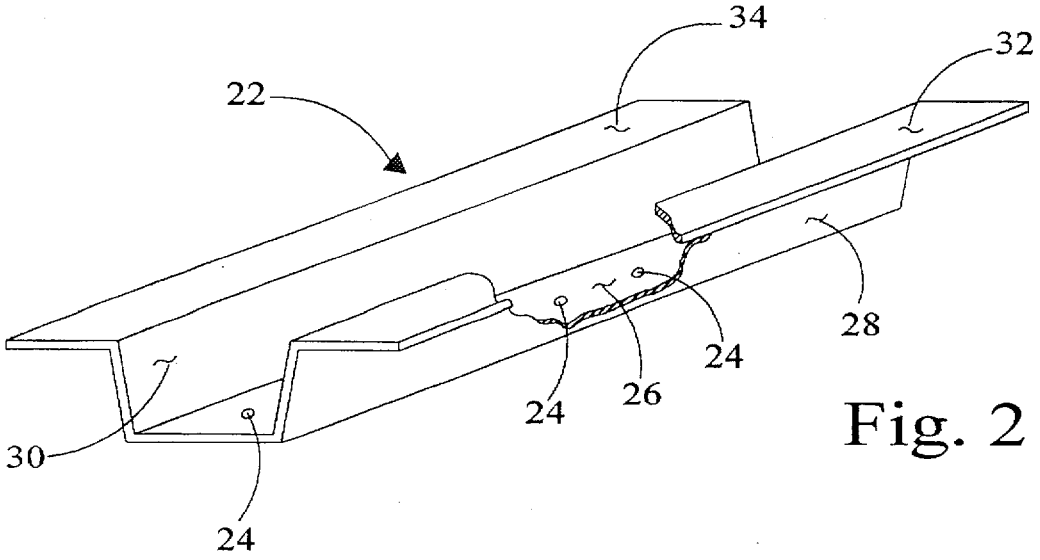
FIG. 2 is a perspective view of the mounting channel of the present invention, with a portion broken away to disclose the mounting apertures for affixing the channel to the structure.

FIG. 2 is a perspective view of the mounting channel member 22 of the present invention, with a portion broken away to disclose the mounting apertures 24 for affixing the channel member 22 to a structure. Channel member 22 is elongated and is generally hat-shaped in cross-section. The hat shape is made up of fastening portion 26, a pair of oppositely disposed wall members 28 and 30, and a pair of mounting shoulders or flanges 32 and 34. Fastening portion 26 has apertures 24 therethrough.

Figure 3:
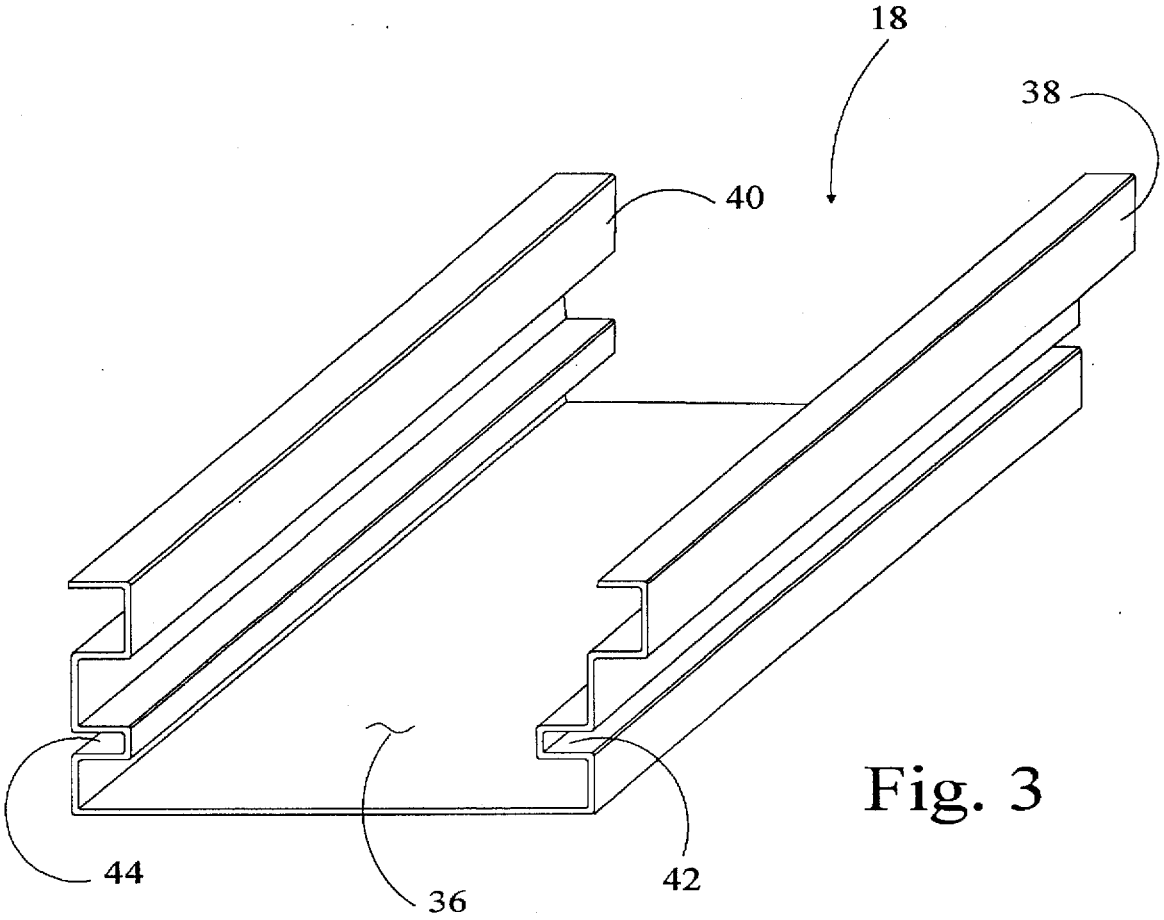
FIG. 3 is a perspective view of a panel.

FIG. 3 is a perspective view of a panel 18. The panel includes a web portion 36 that is generally rectangular. A pair of elevated portions 38 and 40 are oppositely disposed at the edges of web 36. The elevated portions 38 and 40 are configured to cooperate with associated elevated portions of adjacent panels, as will be described in more detail below. A pair of longitudinal mounting slots 42 and 44 are provided in elevated portions 38 and 40, respectively, and each mounting slot is designed to receive an associated one of the mounting shoulders 32 or 34 of a mounting channel member 22. The configurations and relative relationships of the parts of elevated portions 38 and 40 will be described below.

Figure 4:
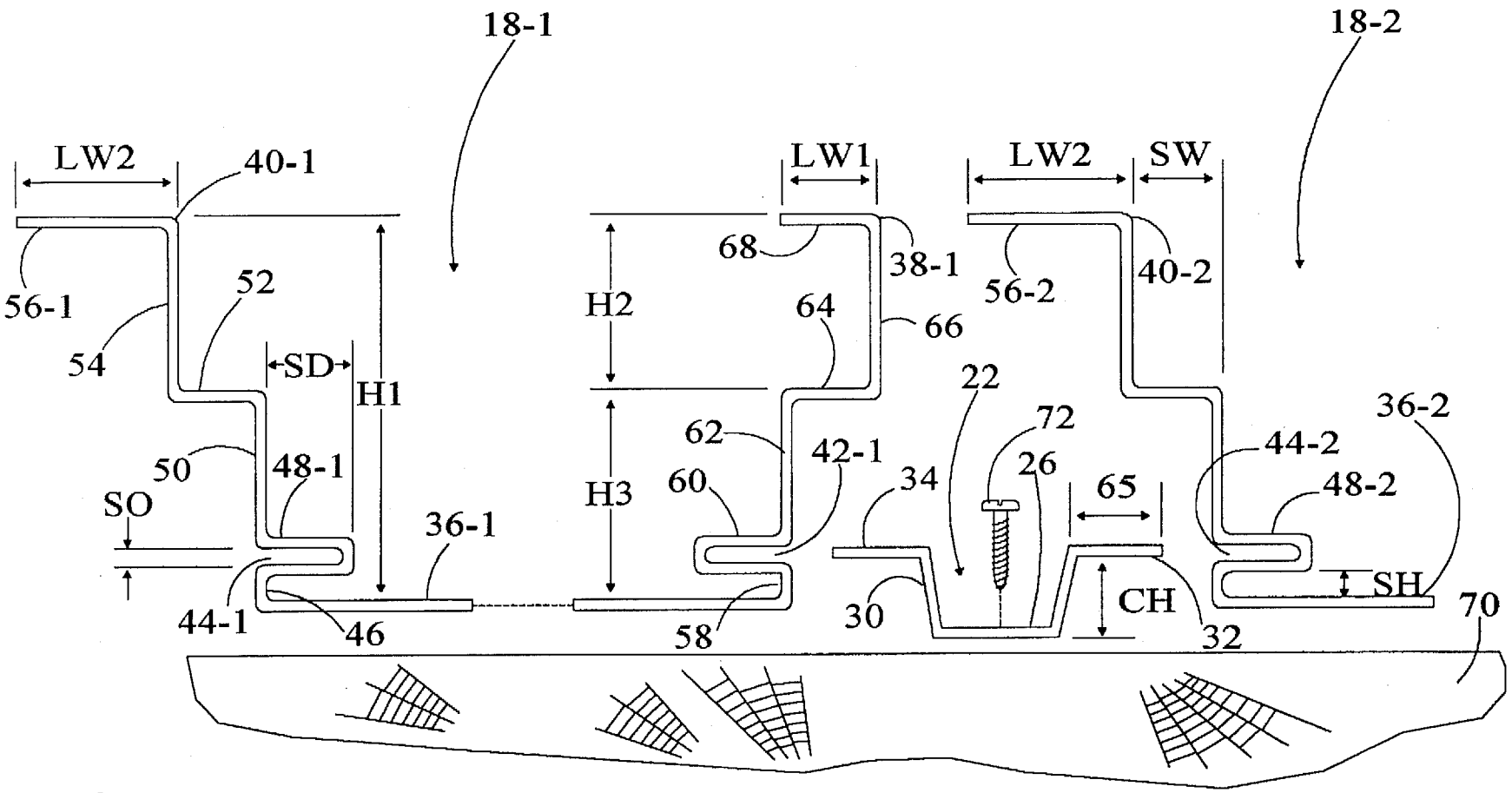
FIG. 4 is a detailed elevation view of separated portions of a pair of adjacent panels and an associated mounting channel member.

FIG. 4 is a detailed elevation view of separated portions of a pair of adjacent panels and an associated mounting channel member. Panel 18-1 has elevated portion 40-1 that is comprised of upright member 46, slot member 48-1 defining slot 44-1, upright chamber member 50, shoulder 52, standing seam member 54, and lock member 56-1. In a similar manner, upright portion 38-1 is comprised of upright member 58, slot member 60 that defines slot 42-1, upright chamber member 62, shoulder 64, standing seam member 66, and lock member 68.

Channel member 22 is illustrated ready to be affixed to a structural member 70 by a fastening device such as screw 72. Elevated portion 40-2 of panel 18-2 has similar elements as described for elevated portion 40-1, and is adapted to cooperate with associated elevated portion 38-1 to engage channel member 22 and form the standing seam.

It has been found to be advantageous to fabricate the panels 18 from sheet material that is in the range of 23 to 26 gauge, and to fabricate the channel members 22 from sheet material that is in the range of 16 to 22 gauge. In general, it is desirable that the channel members be constructed of a heavier gauge material than the panels so that the channel members can provide the necessary strength to support and retain the panels. The sheet material can be any suitable material to satisfy the needs of the selected covering and can be sheet steel, sheet aluminum, sheet copper, or the like. It is desirable that the panels 18 and the channel members 22 be constructed from similar materials so that there is compatibility of similar coefficients of expansion and contraction. However, in addition to the support of the panel along its length, a major advantage of the slot-shoulder engagement is the ability of the slot to slide along the shoulder, as during expansion of the panel, for example.

Characteristic dimensions of the channel member 22 has a channel member height CH of about 0.5 inch and has a channel shoulder width CS of about 0.5 inch. Characteristic dimensions of elevated portions 38-1 and 40-1 are similar with the exception that lock members 58 and 68 differ in length. A characteristic width LW1 of lock member 68 is about 0.5 inch and the width LW2 of lock member 56 is about 0.875 inch, thereby allow a difference length of about 0.375 inch of lock member 56 to be utilized to form the seal.

The over-all height H1 of elevated portion 40-1 is about 2.25 inches, with a slot opening SO of about 0.06 inch and a slot depth SD of about 0.5 inch. The over-all height of elevated portion 38-1 is substantially the same as H1, but with allowance for the gauge of the material to allow mating of the lock members of adjacent panels. The height H2 of seam member 66 is approximately 1.0 inch, as is the height of seam member 54, and the height H3 is about 1.25 inches. The shoulder width SW is about 0.5 inch. The slot height SH is about 0.25 inch. The difference of the channel member height CH and the slot height SH yields a clearance of the bottom of web 36 from the surface of the structural member 70 of about 0.25 inch. This clearance avoids a read through of the structural members through the panel. The over-all width of a panel 18 can be adjusted depending on the gauge material used and available mounting structure for the channel members 22. It has been found that the widths in the range of about twenty to thirty inches are suitable. Obviously, other heights/lengths may be employed within the scope of the invention as desired.

Figure 5:
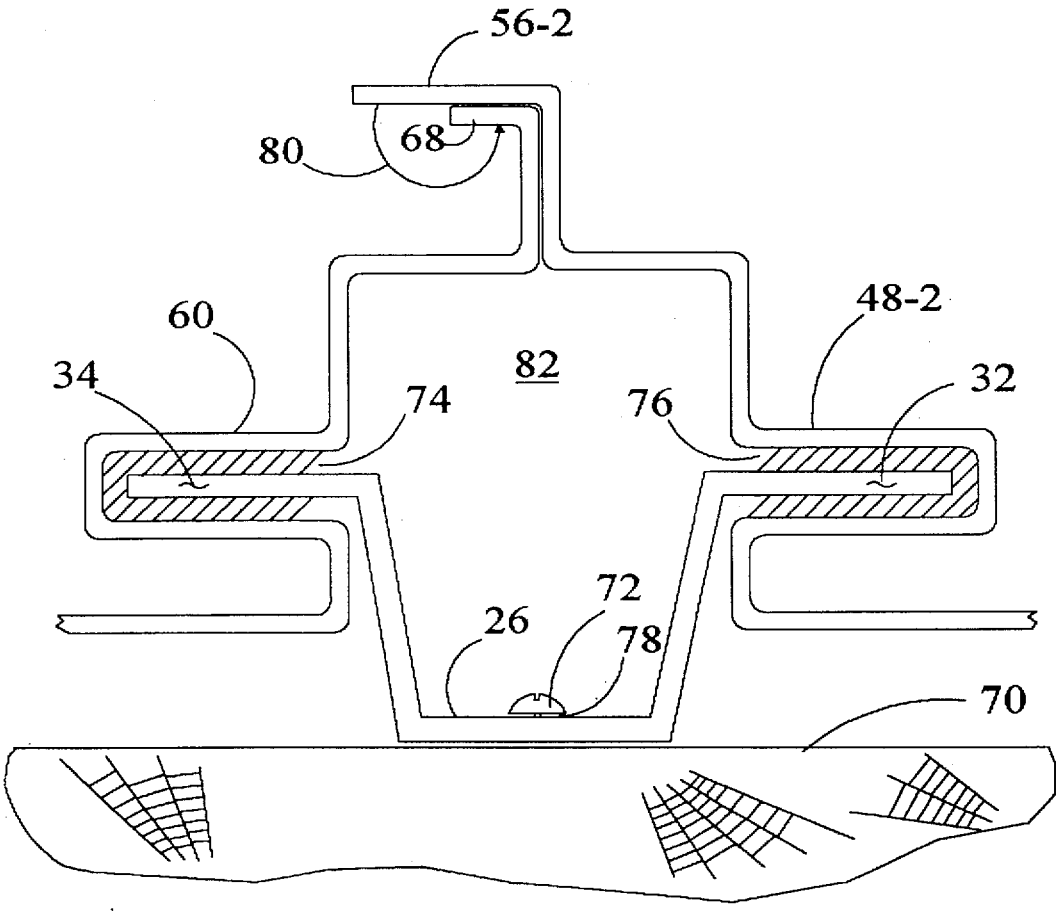
FIG. 5 is a detailed elevation view of associated edges of a pair of adjacent panels mounted to a mounting channel member.

FIG. 5 is a detailed elevation view of associated edges of a pair of adjacent panels mounted to mounting channel member. To aid in forming a water tight seal, caulking material 74 may be placed within slot 42-1 so that it seals mounting shoulder 34 to slot member 60, and caulking material 76 may be placed in slot 44-2 so that it seals mounting shoulder 32 within slot member 48-2. The mounting device, such as screw 72, may have sealing material 78 placed to seal the opening and inhibit passage of any moisture through mounting member 26 to the structure 70. The seam is closed by bending the end of lock member 62-2 in the direction of arrow 80 around lock member 68 or both of members 56-2 and 68 in the direction at arrow 80. It may be desirable to place sealant material (not shown) between the surfaces of lock members 56-2 and 68 to provide additional protection against infiltration of water. When thus assembled a substantially water-tight chamber 82 is established. It should be noted that when the seam is closed by bending of element 56-2 or both of elements 56-2 and 68, their engagement provides a restraining force to prevent separation of the slots (48-2, for example) from the shoulder (32, for example).

Figure 6:
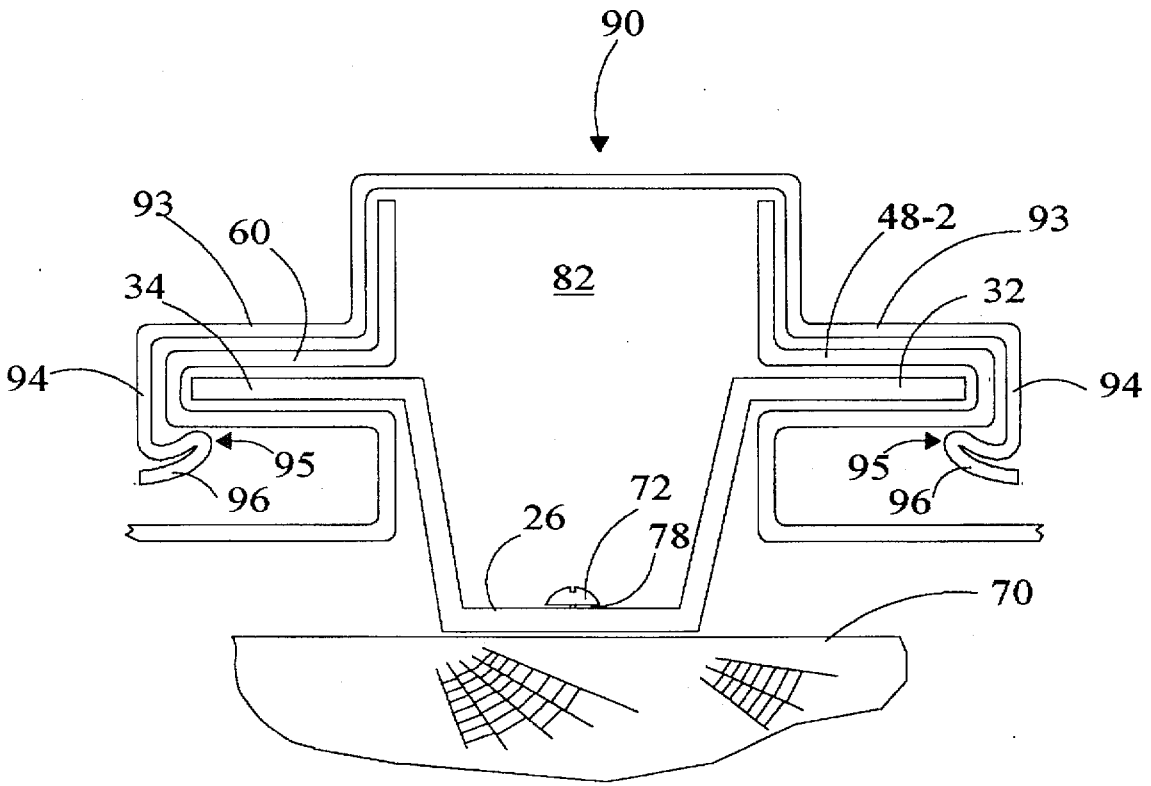
FIGS. 6 and 7 illustrate alternative embodiments to the embodiment of FIGS. 3–5 and, in particular, the associated edges of adjacent panels along with a closure formed as a cap.
Figure 7:
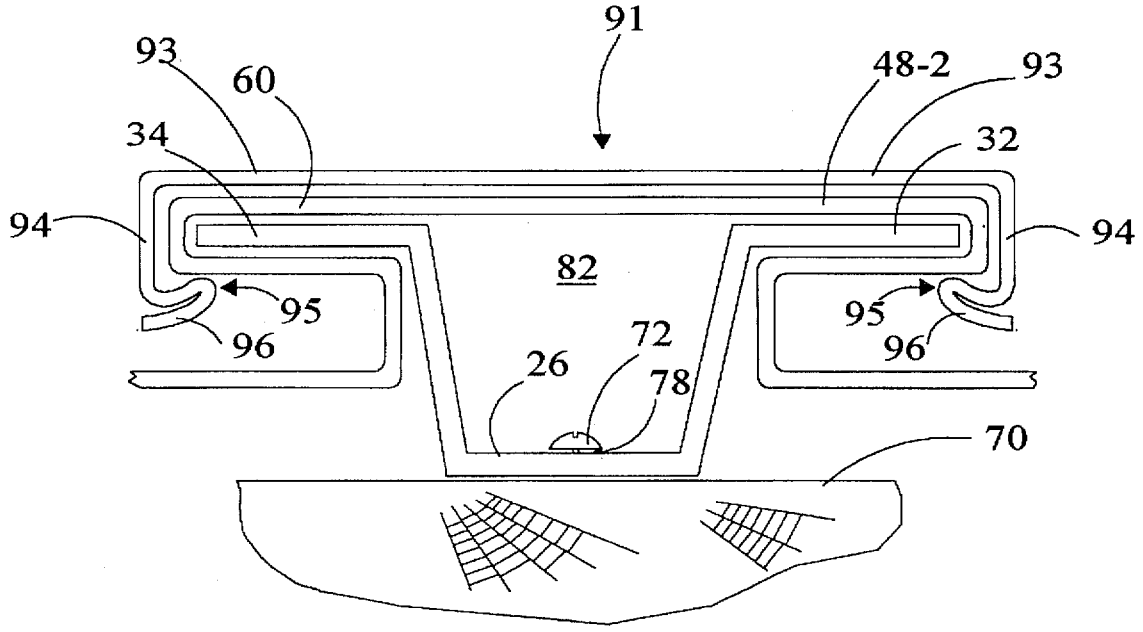

As an alternative to the standing seam structure shown, an interlocking structure of the type disclosed in U.S. Pat. No. 5,247,772, assigned to the assignee of this invention, the disclosure of which is incorporated herein by reference, could be utilized. Alternatively, an interlocking cap may be employed as shown in FIGS. 6 and 7. In FIGS. 6 and 7, like reference numeral indicate like elements to those shown in FIG. 5. However, the upper portion (to varying degrees) is eliminated (including elements 56-2 and 68) and its function of sealing the seam is provided by a cap 90 (FIG. 6) or 91 (FIG. 7). The primary difference between the embodiments of FIGS. 6 and 7 is the height of the seam. When a conventional height standing seam is desired, the configuration of FIG. 5 may be employed. The embodiment of FIG. 6 provides a lower seam. In either case, the cap 90/91 includes extending portions 93 including end walls 94 and clips 95, including camming surfaces 96. As is apparent from FIGS. 6 and 7, with the panel slots fully engaged by the hat channel shoulders, the cap 90/91 may be urged over the assembled structure with the caps opening via the action of the camming surfaces 96 with the clips "snapping" closed over the shoulder/slot assembly to cover the seam and to laterally maintain the slots over the shoulders.

It can be seen from the foregoing description that the objectives of providing an improved mounting system for mounting panels to structures has been achieved. The system allows the use of mounted panels with improved load-bearing properties and with enhanced stability and resistance to wind lift. Further, the mounting system allows panels to be mounted without deformity inherent in many prior art systems and provides an aesthetically pleasing covering. Also, as indicated above, the use of a channel, as opposed to clips, to anchor the panels additionally provides a gutter-like structure within the seam which will direct any moisture entering the seam toward the edge of the roof (or any other structure being covered) where it may be discharged.

Figure 8:
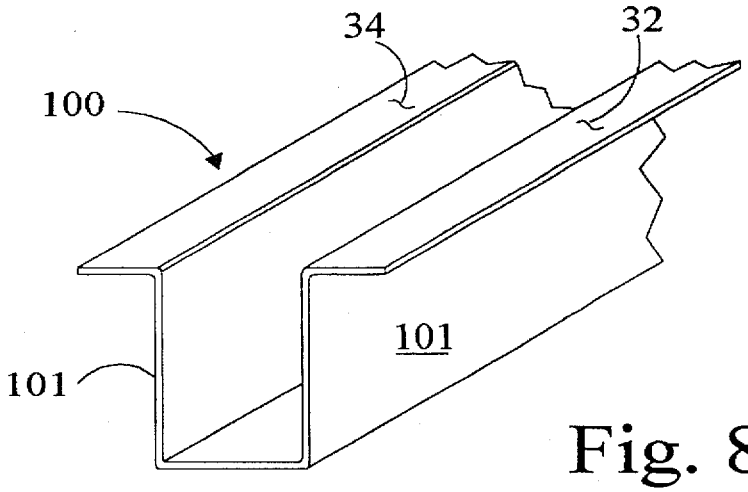
FIGS. 8–10 illustrate further alternative embodiments to the embodiments of FIGS. 3–8 and, in particular, an alternative gutter-forming channel construction and seam closure formed as a cap.
Figure 9:
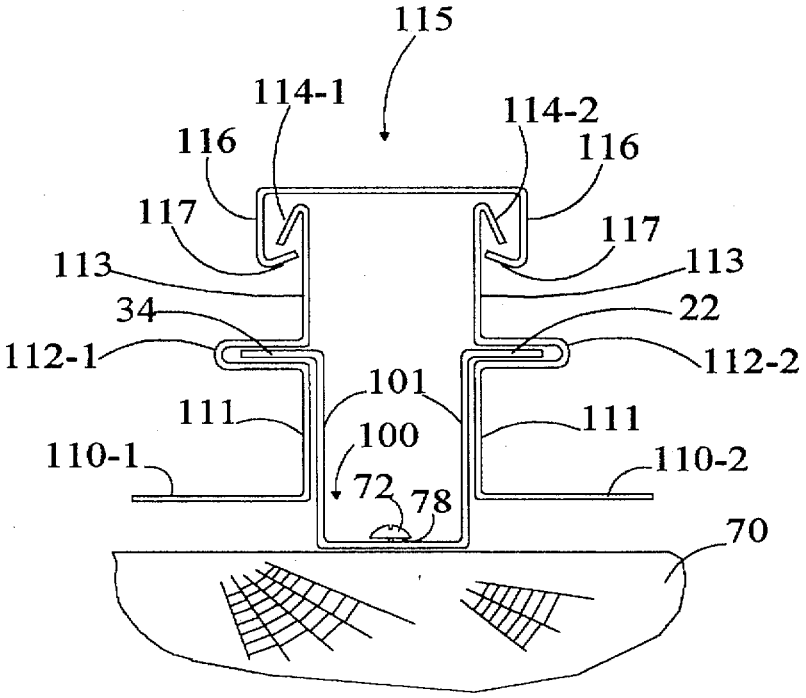
Figure 10:
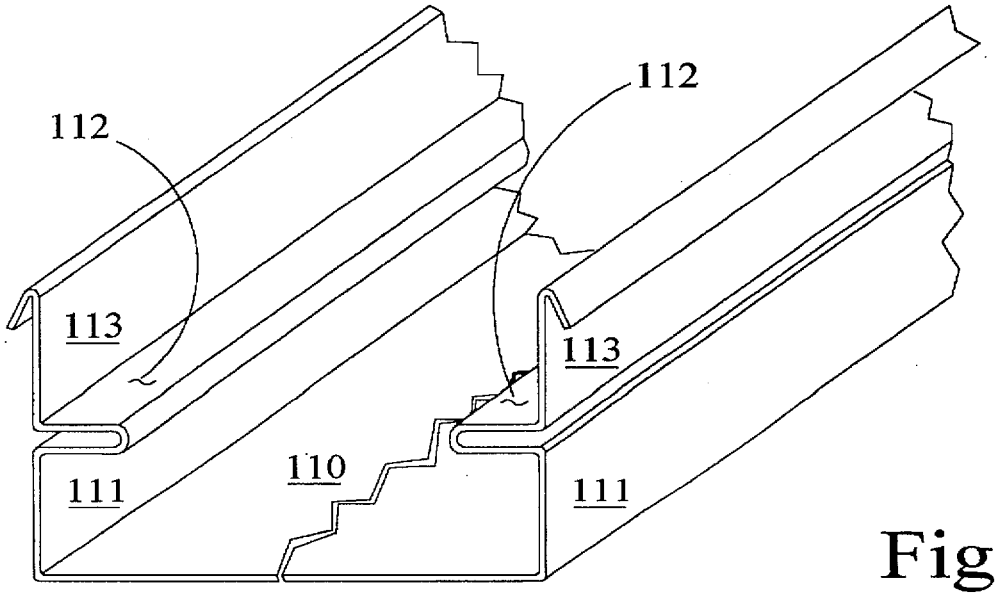

FIGS. 8–10 show a variation of the embodiments discussed above. In particular, the embodiment of FIGS. 8–10 employs a channel member 100. The channel member 100 functions identically to the hat channel described above and differs particularly in that its sides 101 are generally vertical. Mounting apertures (not shown) are provided for fixing the channel member 100 to a structure, as described above. A pair of mounting shoulders or flanges 32 and 34 function identically to the shoulders of the like reference numeral of the channel of FIG. 2 and, like the shoulders 32 and 34 described above, are generally parallel to the channel bottom. Similarly, adjacent panels 110-1 and 110-2 have formed at their side edges upright portions 111, slot members 112-1 and 112-2 and upright chamber members 113. Each of the upright chamber members 113 terminate at downwardly extending ledges 114-1 and 114-2 which may be formed by bending a portion of the members 113 back over themselves to form an acute angle with the members 113. In the illustrated embodiment, an angle of 30° is formed between the members 113 and 114 although any angle less than 90° is believed to be functional. As is apparent from FIGS. 9 and 10, the side edges of each panel are essentially mirror images of each other.

A cap 115 spans the space between the members 1123 and has depending side walls 116 lying over and extending along the ledges 114. The side walls 116 terminate at upwardly extending latching legs 117 which extend toward the members 113 and under the ledges 114 to secure the cap 115 over the seam formed between the adjacent panel edges and defined in its upper region between the members 113. In particular, the legs 117 form an acute angle with the capside walls 116 and engage the ledges 114 to secure the cap 115 over the seam and retain a spaced relation between the members 113 by engagement with the ledges 114. Positioning and placement of the cap 115 is described more fully below with reference to FIG. 11.

Figure 11:
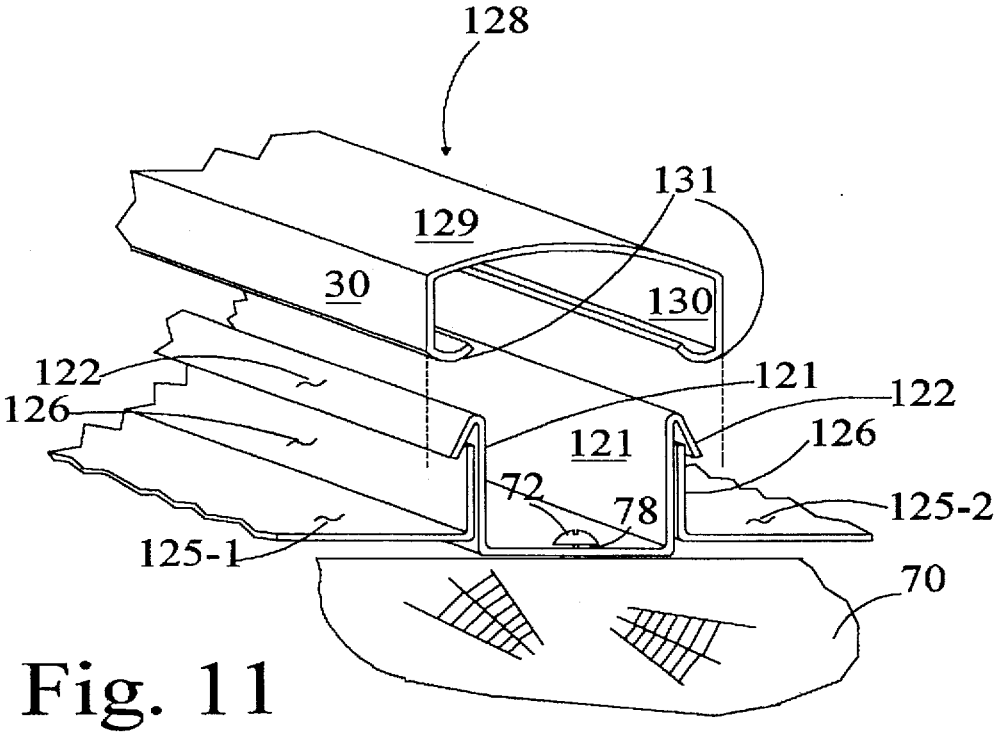
FIG. 11 illustrates a still further alternative embodiment to the embodiments of FIGS. 3–10.

FIG. 11 illustrates a further embodiment of the present invention incorporating elements of the embodiments described to this point. Again, an elongated channel 120 serves to anchor adjacent panels at their edges while forming a gutter like structure, the channel 120 serving to convey any moisture accumulating within the seam between adjacent panels to a discharge. The channel 120 may be anchored as described above.

In the embodiment of FIG. 11, the channel 120 is formed with upright sides 121 terminating at downwardly extending ledges 122, the ledges 112 forming an acute angle with the sides 121. In the illustrated embodiment, the acute angle between the ledges 122 and the sides 121 is 20°. The edges of adjacent panels 125-1 and 125-2 are formed as upstanding members 126 overlying the sides of the channel to extend under the ledges 122. In this manner, the ledges serve to retain the panel edges while allowing elongation and contraction of the panels. The members 126 may extend to the apex of the acute angle between sides 121 and ledges 122. With the terminus of the members 126 so engaged, the edges of the panels 125 are restricted against upward movement.

As shown, the ledges 122 also overlie the joint between the panel edges and upstanding channel sides 121 to seal them from the elements. Further protection is provided by a cap 128 which spans the gap between the channel members and their associated panel edge upstanding ends 126, the cap 128 being formed of an arcuate upper portion 129, depending legs 130 and latching members formed as hooks 131. In position, the hooks 131 latch around the ends of the ledges 122 and secure the cap 128 in position over the seam. The arcuate upper surface 129 of the cap 128 provides a spring function serving to maintain the spacing between the members 126 and, accordingly, the integrity of the seam.

The cap 128 in FIG. 11 is shown spaced from the seam to illustrate placement of the cap to a secured position over the seam. In its placement, the cap is urged down over the seam with the hook members engaging the ledges 122 causing the legs 130 to cam outwardly allowing the cap to be fully positioned. When the hook latches clear the ends of the ledges 122, the legs 130 will "spring" inwardly (including flexure of upper portion 129) causing the hooks 131 to engage the ends of the ledges 122 and maintain them in spaced relation to each other. Although not shown with an arcuate upper surface, the cap 115 of FIG. 9 is positioned similarly with downward movement of the cap 115 during placement causing a camming action and a subsequent engagement between the cap latching legs 117 and the ledges 114.

Numerous characteristics and advantages of the invention have been set forth. It is understood that the description of the preferred embodiment is, in many respects, only illustrative. Changes may be made in details, particularly in matters of shape, size, and arrangement of parts without exceeding the scope of the invention. Having described the preferred embodiment in conjunction with the drawings, it can be seen that the various purposes and objectives have been achieved, and that there are modifications and extensions that will become apparent to those skilled in the art without exceeding the spirit and scope of the invention. Accordingly, what is intended to be protected by Letters Patent is set forth in the appended claims.

What is claimed is:

1. A structure for mounting covering panels to a building roof substructure comprising:

panel supporting channel means forming a gutter for directing moisture entering a seam between adjacent panels and having a fastening portion for securement to a building roof substructure and shoulder members spaced from the fastening portion for restraining the panels from separation from the roof substructure; and elongated panels each having a web and side edges formed by upstanding side members extending generally the length of the panel, the upstanding side members including slot means spaced from the panel web by a distance less than the fastening portion to shoulder member spacing of the channel means with the slot means receiving the channel means shoulder members to space the panels from the roof substructure while restraining the panels from separation from the roof substructure.

2. The structure of claim 1, further comprising closure means for enclosing said channel means.

3. The structure of claim 2, wherein the closure means comprises cap means.

4. The structure of claim 1, further comprising locking means for locking adjacent ones of said panels together.

5. The structure of claim 4, wherein the locking means comprises cap means.

6. The structure of claim 1, wherein said channel means are hat shaped in cross-section.

7. The structure of claim 6, further comprising cap means for closing and securing the seam between adjacent panel edges.

8. The structure of claim 1, wherein said channel means is U-shaped having generally parallel sides.

9. The structure of claim 8, further comprising cap means for closing and securing the seam between adjacent panel edges.

10. The structure of claim 1, further comprising closure means for enclosing said channel means gutter.

11. The structure of claim 10, wherein said closure means comprises a standing seam closure means.

12. The structure of claim 8, wherein the locking means comprises cap means.

13. The structure of claim 1, wherein said upstanding side members of each of the panels further include a mating closure member.

14. The structure of claim 13, wherein said mating closure member on one of said panels mates with said closure member on another of said panels to form a sealed closure along an associated one of said channel means.

15. The structure of claim 13, wherein one upstanding side member of each of the panels includes a first lock leg having a first length and the other upstanding side member includes a second lock leg having a second length longer than said first length, wherein said second lock leg of one panel is formed around said first lock leg of an adjacent panel for locking said adjacent panels to an associated channel means.

16. The structure of claim 2, wherein said closure means comprises a standing seam closure means.

* * * * *